United States Patent [19]

Gerstmann et al.

[11] 4,445,464

[45] * May 1, 1984

[54] HIGH EFFICIENCY WATER HEATING SYSTEM

[75] Inventors: Joseph Gerstmann, Framingham; Andrew D. Vasilakis, Bedford, both of Mass.

[73] Assignee: Advanced Mechanical Technology, Inc., Newton, Mass.

[ * ] Notice: The portion of the term of this patent subsequent to Jul. 13, 1999 has been disclaimed.

[21] Appl. No.: 397,081

[22] Filed: Jul. 12, 1982

Related U.S. Application Data

[63] Continuation-in-part of Ser. No. 149,937, May 14, 1980, Pat. No. 4,338,888.

[51] Int. Cl.[3] ..... F22B 5/00

[52] U.S. Cl. ..... 122/16; 122/18; 126/367; 431/202

[58] Field of Search ..... 122/13 R, 19, 16–18, 122/31 R, 451 R, 448 S, 406 S; 432/222; 431/202

[56] References Cited

U.S. PATENT DOCUMENTS

| | | | |
|---|---|---|---|
| 1,862,630 | 6/1932 | Morrow | 122/18 |
| 2,179,496 | 11/1939 | Czeschin | 122/16 |
| 2,440,998 | 5/1948 | Alexander | 122/16 |
| 2,549,755 | 4/1951 | Burwell | 122/16 |
| 3,388,692 | 6/1968 | Hale | 122/367 C |
| 3,707,142 | 12/1972 | Kobayashi | 122/17 |
| 3,895,607 | 7/1975 | Johnson | 122/367 R |
| 3,917,442 | 11/1975 | Zagoroff | 432/222 |
| 3,954,386 | 5/1976 | Harpenslager et al. | 431/202 |
| 4,222,350 | 9/1980 | Pompei et al. | 122/367 C |
| 4,313,400 | 2/1982 | Walker et al. | 122/13 R |
| 4,338,888 | 7/1982 | Gerstmann et al. | 122/16 |

FOREIGN PATENT DOCUMENTS

| | | | |
|---|---|---|---|
| 2846120 | 4/1979 | Fed. Rep. of Germany | 122/17 |

*Primary Examiner*—Henry C. Yuen

*Attorney, Agent, or Firm*—Hamilton, Brook, Smith & Reynolds

[57] ABSTRACT

A high efficiency gas fired residential water heater includes an insulated, plastic-lined storage tank. The water in the tank is heated by an external heat exchanger which defines a water-walled combustion chamber. The fuel gas and combustion air burned in the chamber are premixed to a near stoichiometric mixture without the use of a blower. Under the force of line pressure or less, the fuel gas is accelerated into an aspirator/mixer which premixes an amount of air sufficient for complete combustion of the fuel gas. The water-walled combustion chamber is particularly suited for substantial recovery of the heat of a pilot flame. The pilot products of combustion heat water at the upper end of the combustion chamber without causing significant convective flow throughout the heat exchanger.

3 Claims, 16 Drawing Figures

HOT WATER OUT
COLD WATER IN
34
32
36
38
40
26
27
22
24
68
2
43
74
64
30
58
84
89
60
62
28
72
88
78
66
44
48
52
50
46
54
56
42

Fig. 2
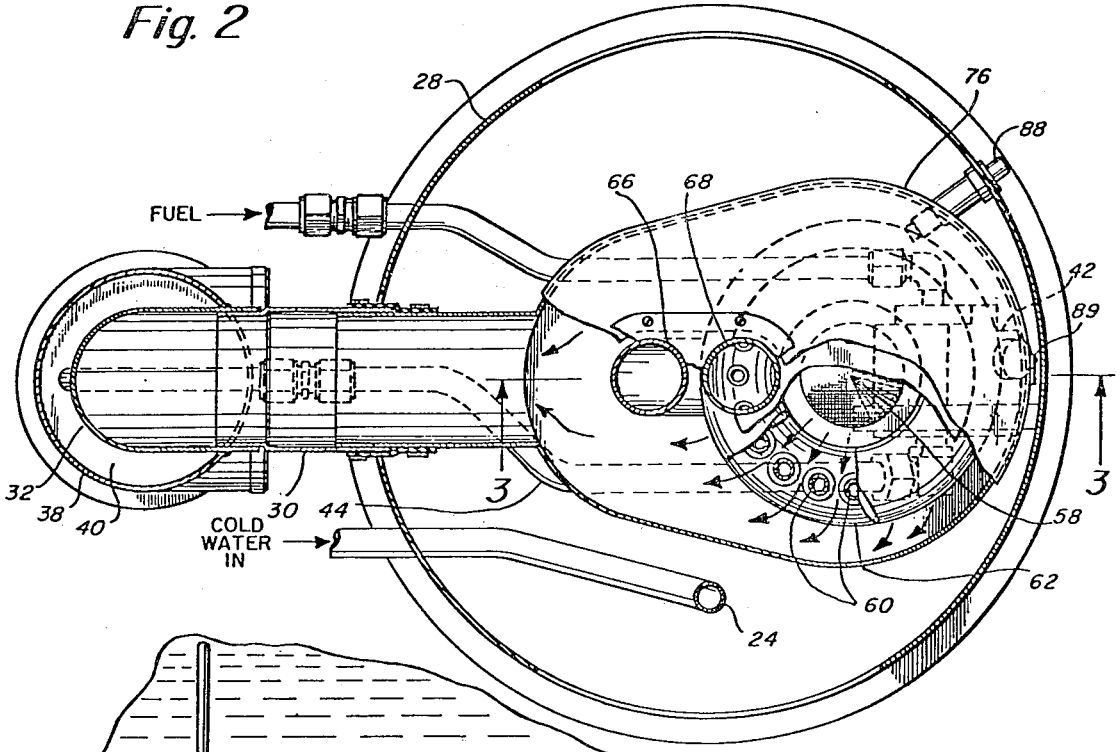
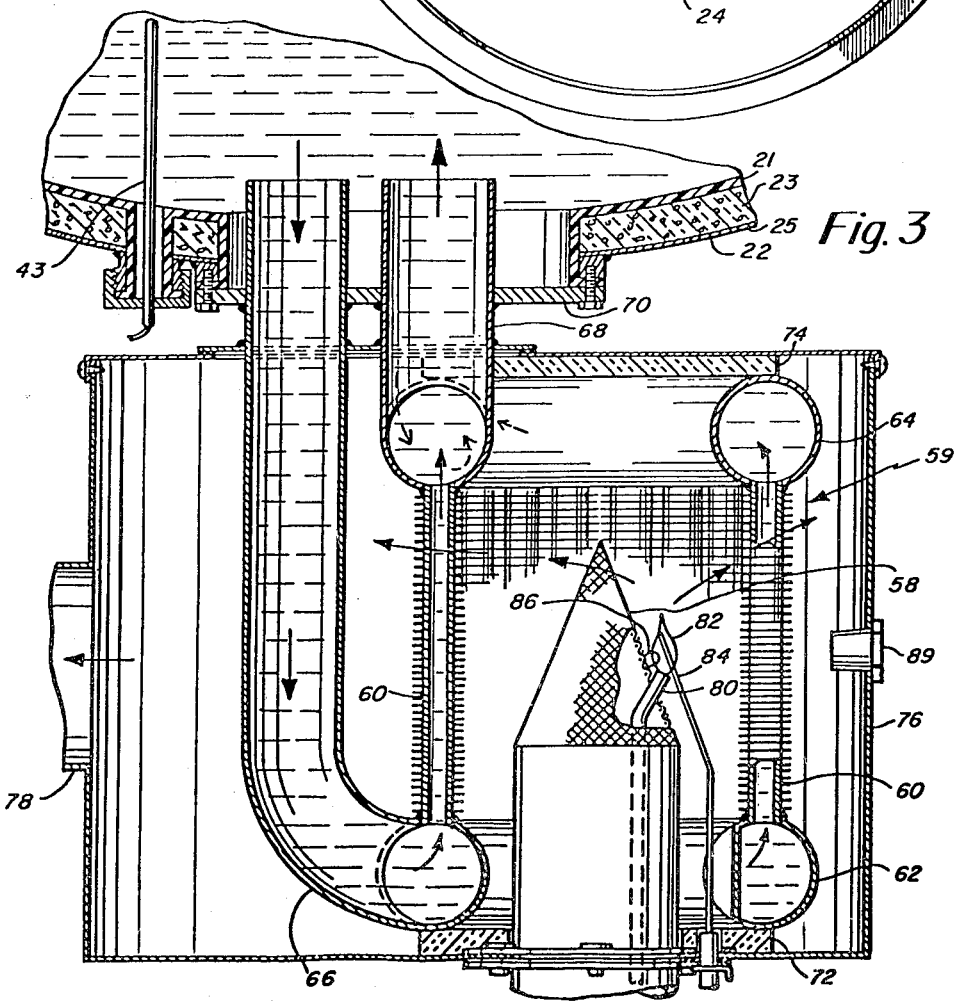
Fig. 3

HIGH EFFICIENCY WATER HEATING SYSTEM

RELATED APPLICATION

This is a continuation-in-part of U.S. patent application Ser. No. 149,937, filed May 14, 1980, now U.S. Pat. No. 4,338,888.

TECHNICAL FIELD

This invention relates to water heating systems and, more particularly, to water heating systems of moderate size which are particularly adapted for use in providing residential domestic hot water requirements.

BACKGROUND

Residential gas-fired water heaters commonly comprise a storage tank in which hot water available for use is stored, and a natural-draft, naturally-aspirated burner which heats the stored water by causing products of combustion to flow over surfaces of the storage vessel. Commonly, the storage tank is a cylindrical shape, is made of "glass-lined" steel, and has a centrally located flue through which products of combustion flow. The flue usually contains baffles and serves as a heat exchanger to transmit heat from the combustion products to the water stored within the vessel. While such water heaters can be simply and economically produced, they are subject to corrosion and, for reasons discussed below, are inefficient.

The combustion assembly commonly used in residential storage type water heaters is of the type in which natural gas initially at line pressure or less aspirates and premixes with an amount of air that is insufficient for complete combustion. Such systems rely upon "secondary air" in the combustion chamber for the additional air necessary to complete combustion. Because there are zones adjacent the burner where gas/air mixtures range from overly rich to overly lean, there is a formation of oxides of nitrogen, an undesirable pollutant. Additionally, because the burn-out of carbon monoxide is limited by the rate of mixing of secondary air, carbon monoxide is not rapidly eliminated. For this reason, large combustion chambers are required for burn-up of carbon monoxide.

Conventional center-flue water heaters which employ secondary air for combustion rely upon the buoyancy of the heated air in the central flue to create a draft which induces the flow of secondary air into the combustion chamber. During the off-cycle, the temperature of the air in the central flue is still sufficiently elevated with respect to normal ambient temperatures that a significant "stack effect" is created. This stack effect produces sufficient draft to produce secondary air flows during the off-cycle which are of similar magnitude to the flow of secondary air during the burner on-cycle. This unwanted convection of secondary air increases the rate of heat loss from the stored water through the walls of the central flue.

In efforts to reduce the production of pollutants and to reduce the off-cycle heat losses from the storage tank, power burners have been suggested. See, for example, U.S. Pat. Nos. 3,823,704 to Daugirda et al. and 3,854,454 to Lazaridis. In such systems, an electric blower is used to draw combustion air into the assembly and to provide a near stoichiometric mix of fuel gas and air upstream of the burner. As a result, there are no overly rich or overly lean zones adjacent the burner to promote the formation of oxides of nitrogen, and the burnout of carbon monoxide is not limited by the mixing of secondary air. Further, because there is no requirement for secondary air, the combustin chamber can be substantially closed but for the burner and exhaust flue so that off-cycle convection through the combustion chamber and in heat exchange relationship with the storage tank is minimized. A major fault of such systems is that the blower used in the forced draft and mixing is costly, requires costly electrical power, and has a limited life.

In the Lazaridis patent, the problems of corrosion of the storage tank are avoided by the use of a plastic lined tank. Also, a center flue is not utilized so that there is little heating of the air in the flue during the off-cycle and the undesired resultant convection through the flue is minimized. The use of a plastic lined storage tank without a center flue does present problems of heat exchange between the combustion products and stored water during the on-cycle. Lazaridis overcomes that problem by use of a heat pipe which leads from the combustion chamber to the interior of the storage tank. Unfortunately, the heat pipe results in a further increase in the cost of the heater system, and the life of the heat pipe, which must remain hermetically sealed, is limited.

Daugirda et al. provide for heat exchange to the water and the storage tank by means of a water walled combustion chamber. But water is driven through the tubes in that chamber by a circulator. Like the blower used for premixing of the gas and air, the circulator is costly, requires electrical power, and has a limited life.

An object of this invention is to provide a storage-type water heater, particularly when utilizing a plastic lined storage vessel, which has high recovery efficiency with low standby losses and which minimizes the formation of noxious pollutants. A further object of the invention is to provide such a water heater which can be manufactured at little additional cost over conventional center-flue water heaters and which does not utilize any electrically powered motors.

DISCLOSURE OF THE INVENTION

A primary feature of hot water systems embodying this invention is that the fuel gas and combustion air are premixed to a near stoichiometric mixture without the use of a blower. Under the force of line pressure or less, the fuel gas is accelerated into an aspirator/mixer. The accelerated fuel gas aspirates combustion air to provide the stoichiometric mix to the burner. In that way, the advantages of a power burner are obtained without the disadvantages arising from the use of an electric blower.

Preferably, the combustion chamber is a water walled chamber positioned externally of the storage tank. Water conducting tubes are preferably arranged in a cylindrical array to define the combustion chamber, and those tubes are in communication with the heated water in the storage tank to provide for natural convective flow of the water through the tubes.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 2 is a cross sectional view of the embodiment of FIG. 1 taken along line 2—2;

FIG. 3 is an enlarged elevational sectional view of the combustion chamber and heat exchanger portion of the embodiment of FIG. 1;

FIG. 16 is yet another embodiment of the invention comprising an annular diffuser.

DESCRIPTION OF PREFERRED EMBODIMENTS

Figure 1:
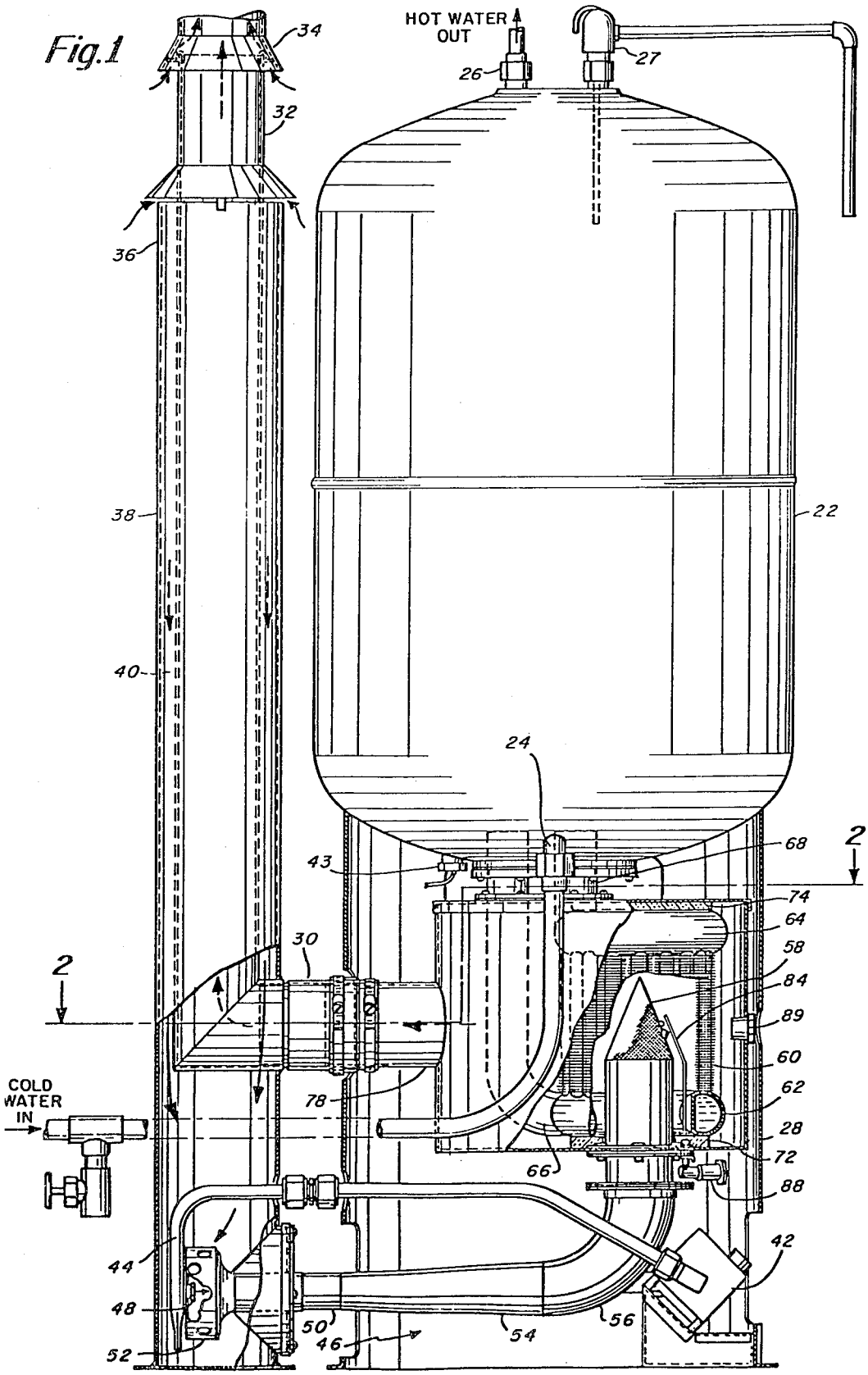
FIG. 1 is an elevational view, partially broken away, of a preferred embodiment of this invention.

As shown in FIG. 1, a hot water storage tank 22 has a cold water inlet 24 and a hot water outlet 26. As shown in FIG. 3, the storage tank 22 is preferably made of a preferred plastic liner 21 surrounded by insulation 23, such as a foam insulation, and a metal housing 25. The tank 22 is supported on a stand 28 which also houses most of the combustion assembly for heating the hot water. A temperature/pressure relief valve 27 is connected to the storage tank.

The products of combustion from the combustion assembly pass through the stand 28 in a flue connection 30 and are directed upwardly through the flue 32 to the exterior of the building. A draft hood assembly 34 controls draft in the flue. Combustion air supplied to the combustion assembly is introduced into the system over the top end 36 of a sleeve 38 surrounding the flue 32. The air passes downward through the annulus 40 between the flue and sleeve and is thus preheated by the products of combustion in the flue.

Natural gas is introduced into the system at line pressure through a thermostatically activated combination solenoid and pressure regulating valve 42. The valve 42 responds to the temperature of the water in tank 22 through a temperature sensor 43. The gas is directed through gas pipe 44 to an aspirator/mixer 46. Under the force of a pressure less than line pressure, the fuel gas is accelerated by a nozzle 48 and is directed into a mixer throat 50. The jet of fuel gas draws combustion air from within the sleeve 38 into an air inlet chamber 52 and through the mixer throat 50. The gas and aspirated air are thoroughly mixed in the mixer 50 and the pressure of the mixture is increased in a diffuser 54. The gas/air mixture, a homogeneous, near stoichiometric mixture for complete combustion of the gas, is then directed upwardly by an elbow 56 to a burner 58. The burner is conically shaped and is formed of foraminous sheet material such as a perforated metal sheet or a screen. Burners or other shapes may also be used. Because the gas and combustion air are completely premixed to the proper mixture for complete combustion, the production of oxides of nitrogen and of carbon monoxide are minimized.

The combustion chamber is a water walled chamber defined by a heat exchanger assembly 59. Vertical finned tubes 60 are arranged in a cylindrical array. The heat exchanger tubes 60 which define the combustion chamber extend between a lower, toroidal header 62 and an upper, toroidal header 64. The headers 62 and 64 are in liquid communication with the storage tank 22 through respective downcomer and riser pipes 66 and 68. The pipes 66 and 68 are connected to the storage tank 22 by means of a plate 70 bolted to the tank. Lower and upper end caps 72 and 74 of refractory material assure that all products of combustion pass from the burner 58 through the array of tubes 60. Water within those tubes is efficiently heated. The heating of the water in the tubes 60 relative to the water in the downcomer tube 66 results in a natural convective flow of water from the storage tank into the tubes 60 and of hot water back into the storage tank 22.

The external heat exchanger assembly is of particular advantage in use with a plastic lined storage tank. Such a storage tank generally cannot withstand the high temperatures imposed on the liner by an internal heat exchanger such as in a center flue type.

The combustion chamber is surrounded by a metal shroud 76 which directs the products of combustion to a flue outlet 78. Because the fuel gas and combustion air are completely premixed upstream of the burner 58, the shroud can be completely closed but for the burner and the exhaust flue. No secondary air is necessary for complete combustion of the gas.

One hundred percent premixing of the gas and air provide a very hot, concentrated, well mixed flame. Because carbon monoxide is quickly oxidized in that flame a small combustion chamber can be used. In this system, the combustion chamber within the heat exchange tubes 60 has a volume of about 3 liters; whereas in conventional systems which require secondary air the combustion chamber of a like-capacity system has a volume of more than 10 liters. The small combustion chamber minimizes the expense of the copper tubing used in the heat exchanger assembly and, as will be discussed below, provides for efficient recovery of heat from the pilot flame.

Figure 4:
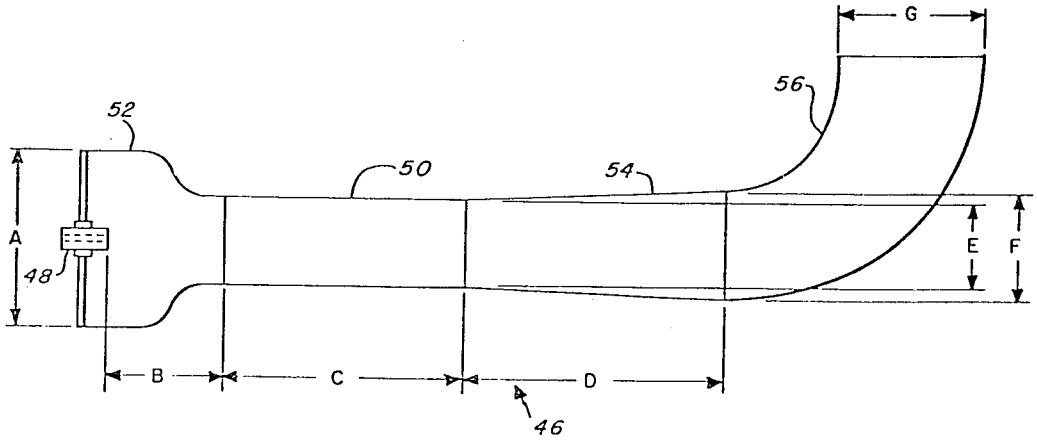
FIG. 4 is a schematic of the aspirator/mixer of the system of FIG. 1 referencing specific dimensions of the aspirator/mixer.

One hundred percent premixing of the fuel gas and combustion air has been obtained previously, without the use of a blower, in high pressure propane systems. But the minimally acceptable pressure of natural gas available at the gas manifold of a home appliance is about 6.5 mm. Hg. Heretofore, a blower has been required for 100% premixing of the gas and air. An aspirator/mixer design which enables 100% premixing of the fuel gas and air utilizing only the energy available from the flow line pressure of the natural gas is shown in FIG. 4.

The dimensions of the combustion air inlet diameter A, nozzle to throat distance B, mixer length C, diffuser length D, mixer throat diameter E, diffuser exit diameter F and elbow exit diameter G are given in the following table for a 40,000 BTU/hr burner and for a generalized burner, where Q is the firing rate in BTU/hr.

| Dimension | 40,000 BTU/hr burner (Inches) | Generalized burner (inches) |
|---|---|---|
| A | 4. | .02 $\sqrt{Q}$ |
| B | 2.3 | .011 $\sqrt{Q}$ |
| C | 5. | .02 $\sqrt{Q}$ |
| D | 12. | .06 $\sqrt{Q}$ |
| E | 1.6 | .008 $\sqrt{Q}$ |
| F | 2.5 | .01 $\sqrt{Q}$ |
| G | 3. | .02 $\sqrt{Q}$ |

The most critical dimensions in that design for providing 100% premixing at 6.5 mm Hg manifold pressure are the nozzle to throat distance B and the mixing throat diameter E.

In order to reduce the size of any one aspirator/-mixer, the complete aspirator/mixer assembly may comprise more than one unit. Each unit would be as shown in FIG. 4. The dimensions of each unit would be scaled by the BTU/hr supplied by each unit. For example, in a 40,000 BTU/hr assembly having two aspirator/mixer units, each unit would be scaled according to the above table with Q equal to 20,000 BTU/hr.

A small gas nozzle 80 protrudes through the burner 58 to support a pilot flame 82. The pilot flame can be ignited by an arc between an electrode 84 and a flame-sensing thermocouple 86 or the nozzle 80. The arc is triggered by actuation of a switch 88 (FIG. 2). The pilot flame can be viewed through a window 89 in the shroud 76.

As noted above, in conventional systems little if any heat energy is derived from the pilot flame, and an object of this invention is to provide for substantial recovery of the heat of the pilot products of combustion. To that end, the arrangement shown in detail in FIG. 3 provides for radial flow of the combustion gases through the heat exchanger tubes 60. Because the combustion chamber within the heat exchanger assembly is small the flow path of products of combustion of the pilot past the heat exchanger assembly is short. Those products of combustion rise within the combustion chamber and flow along a strata over the cooler, off-cycle air in the combustion chamber. Because the pilot products of combustion do not mix with the cooler air to a significant degree before passing through the heat exchanger assembly, substantial recovery of the thermal energy from the pilot is recovered by the liquid within the heat exchanger.

The pilot products of combustion first flow into the region within the header 64 into heat exchange relationship with the header. Heat is extracted by the water in the header before the thus cooled pilot gases flow between the tubes 60, so there is only minimal heat exchange at those tubes. Also, those gases flow past the upper end of the heat exchanger tubes 60 and beneath the header 64. Further, the riser 60 is of a sufficiently large diameter that convection which results from the heating of water by the pilot flame is completed within the riser 68. During the off cycle, cold water flows down and hot water flows up the riser 68 as shown by the broken lines, and convection through the downcomer 66 is minimal. Thus there is no cooling of the hot water stored in the storage tank which might result with convective flow through the entire heat exchanger assembly during the off cycle.

This unique stratified flow of the pilot products of combustion past the heat exchanger assembly results primarily from the use of a small combustion chamber, surrounded by the water walled heat exchanger, with the pilot flame positioned such that the products of combustion follow a short path over cooler stationary air through the heat exchanger assembly.

Along with the stratified flow of pilot products of combustion, the arrangement of the heat exchanger assembly and of the exhaust flue relative to the storage tank minimize heat losses from the stored water during the off cycle.

The heat exchanger is external to the tank and is connected to the bottom of the tank. With natural stratification of water, the hottest water is at the top of the tank, completely out of heat exchange relationship with any off cycle convecting air. Only the least warm water in the tank is adjacent the downcomer and riser pipes 66 and 68. And even that water is substantially out of heat exchange relationship with the convecting air because, as noted above, convection of water down the downcomer pipe is avoided.

The flue completely bypasses the storage tank so that there is no heating of the off cycle air by the stored water. Off cycle flow through the flue results only from heat stored in the flue during the on cycle and from the pilot combustion. Even that flow is minimized by use of the preheating arrangement of the sleeve 38 around the flue 32.

Figure 5:
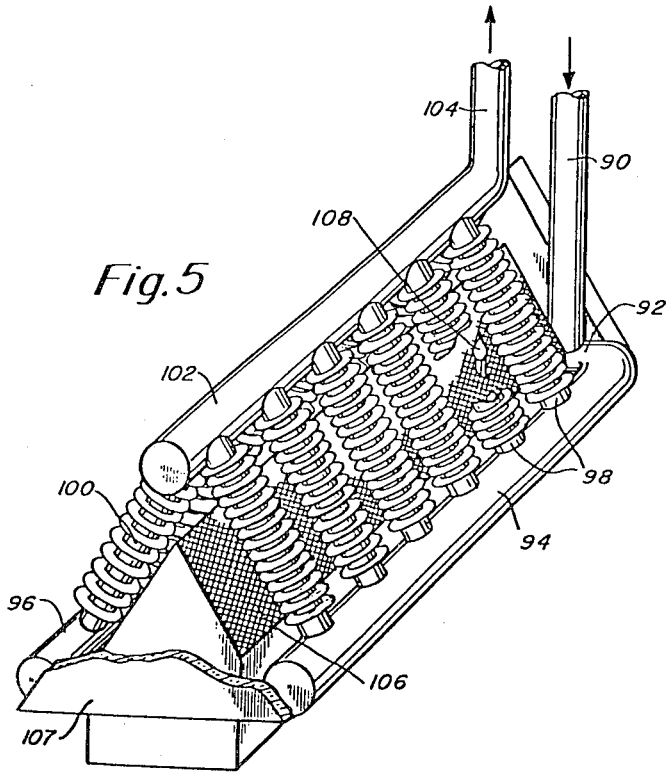
FIG. 5 is a perspective view of an alternative combustion chamber and heat exchanger in which the heat exchange tubes form a tent-like structure.

Another configuration of the water walled combustion chamber which provides for efficient heat exchange between the combustion products and the water during the heating cycle but which also minimizes off cycle heat exchange and provides for substantial recovery of the heat from the pilot flame is shown in FIG. 5. Water to be heated flows down thrugh the downcomer pipe 90 into a pipe 92 which splits the water into two linear bottom headers 94 and 96. A number of heat exchanger tubes 98 and 100 angle upward to a single header tube 102 in a tent-like configuration. The water heated in the heat exchanger tubes and header flows up through the riser 104 to the storage tank by convection. A linear, two faced burner 106 also has an inverted-V shape and is positioned within the compact combustion chamber defined by the heat exchanger assembly. Each end and the bottom of the combustion chamber is closed by refractory material 107. As before, the pilot 108 is positioned so that its products of combustion follow a path upward and out through the heat exchanger tubes at the upper end thereof. The resultant stratified flow of the combustion products results in high recovery of the heat from those products.

Figure 6:
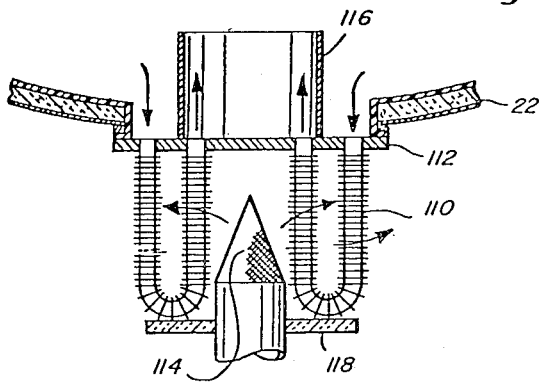
FIG. 6 is a partial elevational sectional view of yet another embodiment of the combustion chamber and heat exchanger in which the heat exchanger tubes are U-shaped tubes mounted directly to the water storage tank.
Figure 7:
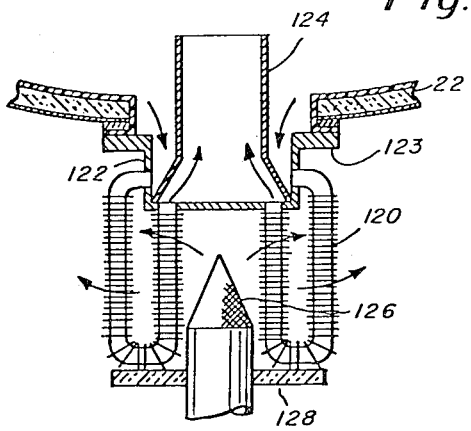
FIG. 7 is another embodiment of the combustion chamber and heat exchanger similar to that in FIG. 6 but with a modified connection to the storage tank.
Figure 8:
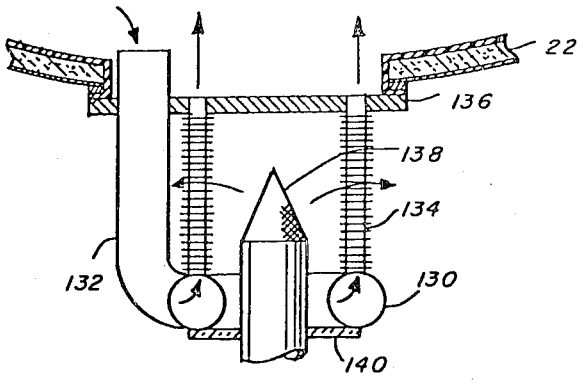
FIG. 8 is yet another alternative arrangement of the combustion chamber and heat exchanger in which the heat exchanger tubes extend between a bottom header and the storage tank.

Several modifications of the cylindrical array of tubes forming the heat exchanger/combustion chmber are shown in FIGS. 6–8. In FIG. 6, U-shaped heat exchanger tubes 110 are connected directly to the storage tank through the plate 112. The inner legs of the tubes define the combustion chamber and are heated by the burner 114. The outer legs of the tubes also extract heat from the combustion gases but to a lesser extent so that convective flow of the water through the tubes is induced. A flow directing ring 116 mounted to the top of the plate 112 keeps the heated water and the cooler water from the storage tank separate at the mouthes of the U-shaped tubes 110 to assure a proper convective flow through the tubes. As before, a bottom cap 118 of refractory material is provided. Unlike the embodiment of FIGS. 3 and 5, the combustion chamber in this embodiment is not completely isolated from the storage tank. There is some heat exchange between the combustion chamber and the water in the storage tank through the plate 112. This heat exchange is minimal, however, and because the water in the storage tank is stratified the warm pilot products of combustion are in heat exchange with the coolest water in the tank during the off cycle. Thus, there is still recovery of the heat from the pilot without the losses which result with the extended heat exchange surface of a conventional center flue system.

FIG. 7 shows a heat exchanger design similar to that in FIG. 6 but for use with a smaller opening at the bottom of the storage tank. In this embodiment, U-shaped heat exchanger tubes 120 are connected to a cup 122 below the plate 123. An annular flow divider 124 is provided as before. Also, a burner 126 is positioned within the heat exchanger element, and a plate of refractory material 128 is positioned below the combustion chamber.

In FIG. 8, a bottom header 130 is connected to the storage tank through a downcomer pipe 132 as in the embodiment of FIG. 3. In this case, however, the heat exchanger tubes 134 are straight tubes which extend from the bottom header 130 directly through the plate 136 into the storage tank. As before, the burner 138 is positioned within the combustion chamber defined by the heat exchanger tubes, and a refractory plate 140 is positioned below the combustion chamber.

Figure 9:
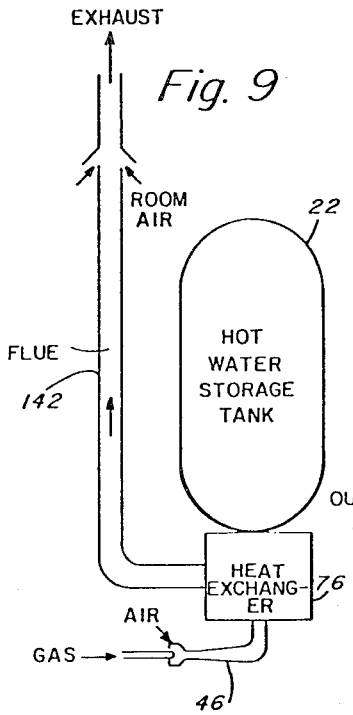
FIG. 9 is an alternative arrangement of the combustion air inlet in which the combustion air is not preheated.
Figure 10:
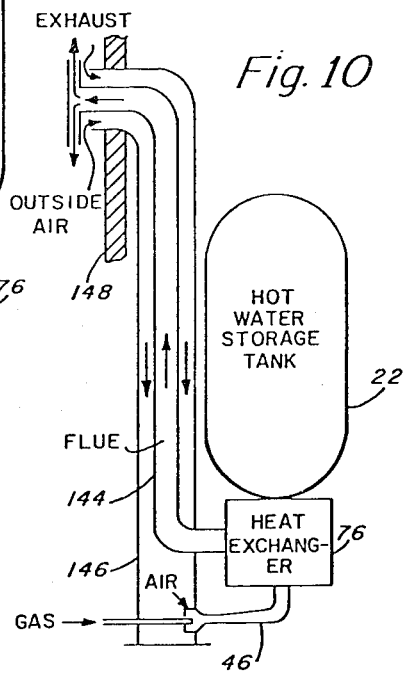
FIG. 10 is a schematic of another arrangement of the combustion air intake in which the combustion air is taken from outside of the building.
Figure 11:
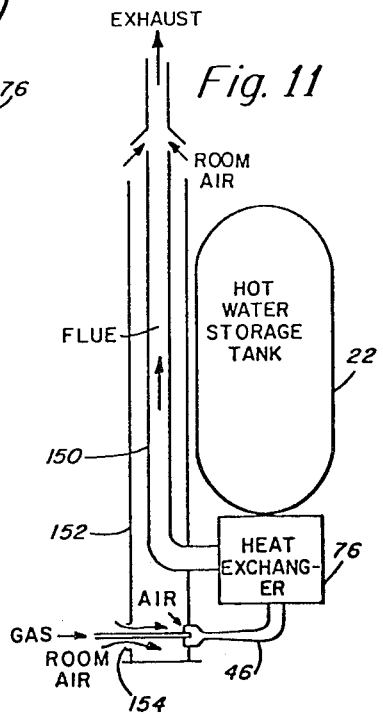
FIG. 11 is a schematic of yet another arrangement in which room air is provided directly to the aspirator but in which the flue is still surrounded by an insulating sleeve.

FIGS. 9, 10 and 11 show alternative arrangements of the combustion air inlet and the flue. In FIG. 9, combustion air is drawn directly from within the room in which the heater stands into the aspirator/mixer 46, and products of combustion pass up through a flue 142.

In the embodiment of FIG. 10, the flue 144 is surrounded by a sleeve 146. Combustion air is preheated in that sleeve before it is drawn into the aspirator/mixer 46 as in the embodiment of FIG. 1; but in this embodiment the combustion air is taken from outside of the exterior wall 148 so that conditioned air in the interior of the building is not extracted by the hot water heater system. This is the most efficient system.

In the embodiment of FIG. 11, the flue 150 is surrounded by a sleeve 152, but that sleeve is provided for insulating purposes only. Combustion air is taken from the building interior primarily through an opening 154 in the sleeve 152.

Figure 12:
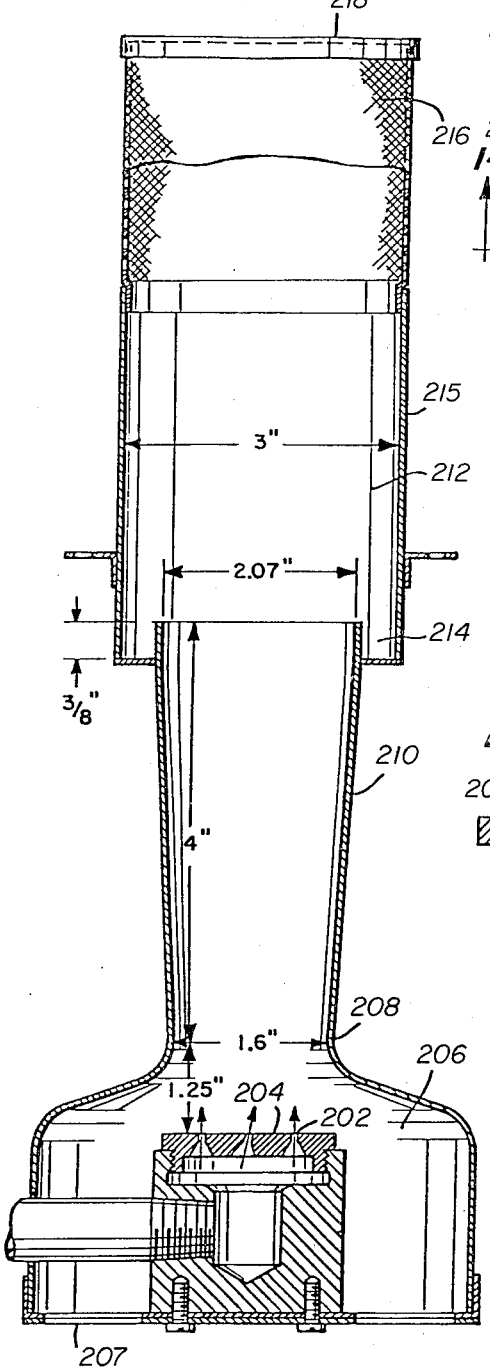
FIG. 12 is a longitudinal sectional view of a burner assembly embodying the present invention.

A preferred embodiment of a 40,000 Btu/hr burner, intended for use in the water heater described above, is shown in FIG. 12. This aspirator/mixer is more compact, easy to package into an appliance, and less expensive to manufacture than the device described above. The aspirator/mixer of FIG. 12 is vertical and in line with the burner and is considerably shorter than that of FIG. 1. Further, this aspirator/mixer and burner does not produce any loud noises during operation over a wide range of air/fuel ratios. Noise amplification under certain operating conditions has been found with the longer, horizontal aspirator/mixer of the previous embodiments.

Figure 13:
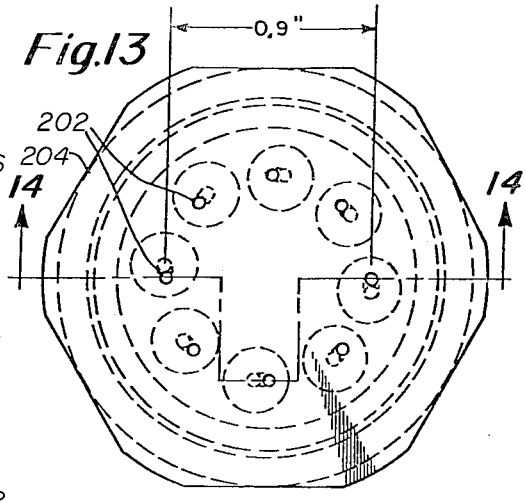
FIG. 13 is a front view of the nozzle assembly of FIG. 12.

As shown in FIG. 13, there are eight nozzles 202 machined in a nozzle plate 204. Gaseous fuel at line pressure or less is accelerated in the nozzles 202 and is expelled as jets into the air inlet 206. In the air inlet 206, air is accelerated by the negative pressure in the throat 208, as well as by entrainment into the gas jets issuing from the eight nozzles 202. The amount of air which is aspirated can be adjusted by adjusting the open area in a shutter 207.

The eight fuel jets issuing from the nozzles 202 accelerate the combustion air and mix with the combustion air, and the jets thereby expand in width so as to fill the throat 208 of the device with a relatively high velocity mixture at a slight negative pressure relative to atmospheric pressure. This high velocity mixture is decelerated in a conical diffuser 210 so as to increase the static pressure.

The conical diffuser 210 discharges into a cusp diffuser 212 which comprises a cusp 214 and a constant diameter tube 215. The gas at the discharge of the cusp diffuser is at a slight positive pressure and the gas flows into the flameholder 216 which comprises a cylinder of perforated metal with a solid end cap 218. Combustion occurs on the outside of the flameholder 216, which would be located in the combustion chamber of the water heater described above with respect to FIGS. 1–3. The specific dimensions of the aspirator for the 40,000 Btu/hr burner are given in FIG. 12 for the aspirator and in FIG. 13 for the nozzle plate 204, where the fuel supply pressure is 4.3 inches W.C. (water column) or 1070 Pascal in S.I. units.

Figure 14:
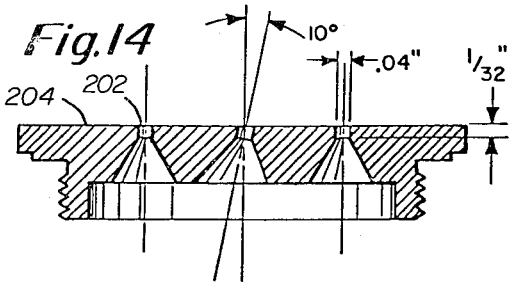
FIG. 14 is a sectional view of the nozzle assembly of FIG. 13 taken along lines A—A.

FIG. 14 shows that the nozzles 202 are machined at a slight (10°) angle to the perpendicular. This imparts swirl to the flowing air/fuel mixture in the air inlet 206, the throat 208 and the diffusers 210 and 212. This swirling flow helps provide rapid mixing between the fuel and air, and helps to improve the efficiency of the diffusers 210 and 212. Without the swirl, this device would be capable of pumping significantly less air.

The benefits of this embodiment include all the benefits of the aspirator/mixer and burner of FIGS. 1 and 4 in that the device: (1) mixes all of the combustion air with the fuel as primary air, (2) delivers this mixture to the combustion chamber at a slight positive pressure and (3) relies on the pressure of the fuel at line pressure or less as the driving force. Furthermore, this embodiment is significantly shorter than that device, is less expensive to manufacture than that device and does not produce loud combustion noise over a wide range of air/fuel ratios.

Proper throat diameter (1.6 inches in this case) and the diameter (0.041 inches) of the nozzles 102 are critical to correct operation of this device. The circular array should have a diameter of about 0.9 inch and it should be spaced about 1.25 inches from the throat 208. All other dimensions are less critical. However, reasonable variation in manufacturing of any dimension will not materially affect overall performance.

This embodiment is capable of mixing up to 200% of the air required for complete combustion under certain conditions. It is recognized that the actual flow through the aspirator are in part determined by downstream flow conditions. For example, the hole pattern chosen for the flameholder affects the diffuser outlet pressure, as does the pressure drop of the combustion products through any heat exchanger and up the stack. Stack draft, caused by the buoyancy of hot combustion products in a vertical exhaust vent decreases the diffuser outlet pressure. The lower the diffuser outlet pressure, the greater the flow which this aspirator can pump. Thus, there is some design flexibility in that if the pressure drops are low while stack draft is high, then less efficient aspirator performance is required to achieve the same air/fuel ratio. In practice, for reasonable pressure drops and reasonable stack draft, this device achieves 100% premixed combustion where the prior art could not.

Figure 15:
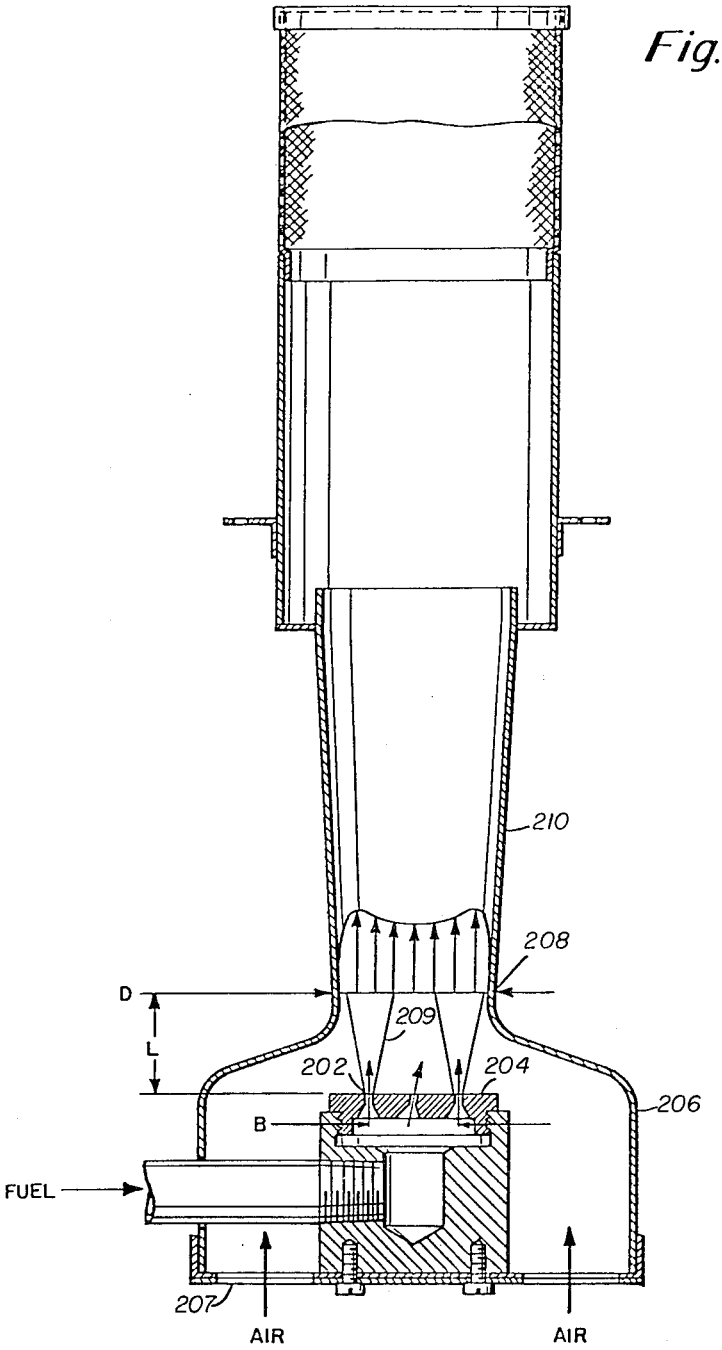
FIG. 15 is a schematic illustration of the nozzle and throat of the assembly of FIG. 12 illustrating the expansion of the initial high velocity fuel stream to an air fuel stream having a substantially uniform velocity profile.

This embodiment can be modified to achieve a wide range of firing rates and geometries. In order to achieve a new firing rate, first a throat diameter is determined. As a first approximation, the diameter D of the throat in FIG. 15 should be selected so as to achieve the same average velocity as that in the preferred embodiment. The nozzle arrangement should be selected so that the expanded jets 209 fill the throat 208, as shown in FIG. 15. The "bolt" circle B and the length L can be chosen with the number of jets N so as to fill the entire throat, providing a reasonably uniform velocity profile at the inlet of the conical diffuser. With such a profile, the forward velocity of the air-fuel stream at about its outer periphery is approximately equal to the mean velocity of the air-fuel stream. Thus, a maximum velocity is maintained near the periphery of the flow so as to maximize entrainment and minimize the potential for flow separation in the diffuser.

By Angling the jets slightly, swirl may be introduced in the flow. The conical diffuser should have roughly the same slope as the one used in the preferred embodiment. The cusp diffuser can be designed in accordance with conventional engineering practice. It is recognized that these are only general guidelines and that precise definition of dimensions requires some degree of experimentation and empirical refinement.

The aspirator may be modified by the substitution of any generally circular array of gas jets for the one specified in the preferred embodiment. The jets should jointly have a generally annular cross-section at the nozzle assembly. A single annular jet would also suffice but would likely be more expensive to manufacture. This is because small dimensional errors would introduce large fuel flow variations, thus requiring either extremely close dimensional tolerances or an adjustment capability.

The geometry may easily be modified to suit packaging requirements in any particular appliance application. The preferred embodiment utilizes a conical diffuser followed by a cusp diffuser so as to fit the constraints of the water heater of FIG. 1. These constraints are a three-inch diameter diffuser discharge, minimum aspirator length, minimum cost, and sufficient air pumping for that particular heat exchanger and venting system. The diffuser section closest to the flameholder, in this case the cusp diffuser, must be of a material which is not corrosive at the high temperatures at that section. Such high cost material can be formed less expensively into a simply cylinderical section than into a conical diffuser, and the material need not be used in the conical diffuser which is spaced from the flameholder.

It is possible to utilize this invention with any well-designed diffuser so as to fit better into an appliance. The preferred embodiment uses a generally axial diffuser. A radial diffuser could also be used. Some minor changes such as increased swirl angle or the use of a short (½" long) straight section in the aspirator throat, may be made.

Another embodiment is shown in FIG. 16. This uses an annular diffuser 238 formed between conical sections 240 and 242. It is a hydrid of the axial and radial diffusers. Other diffusers could be used including: a conical diffuser without a cusp diffuser, a cusp diffuser without a conical diffuser, a Coanda effect diffuser, and so on. All of these diffusers can be found in the general engineering literature and their adaptation to this invention is relatively straightforward. Each might offer unique geometrical and/or cost benefits for varied applications.

While the inventiion has been particularly shown and described with reference to preferred embodiments thereof, it will be understood by those skilled in the art that various changes in form and details may be made therein without departing from the spirit and scope of the invention as defined by the appended claims. For example, an electronic ignition may be used to light a pilot flame only when the burner is to be lit.

We claim:

1. A storage water heater of the type having an insulated water storage tank, a water inlet and a water outlet to and from the water heater, and a gas fueled combustion assembly in which gas initially at line pressure or less mixes with combustion air without power assist and is ignited in a combustion chamber to heat water in the storage tank, the water heater comprising:

aspirator/mixer assembly means comprising a venturi mixer tube a diffuser at the outlet of the mixer tube, an air inlet to the mixer tube and a fuel gas nozzle at the inlet for receiving fuel gas at line pressure of 6.5 mm Hg or less and forming a gas jet to draw air through the inlet to mix with the gas in the mixer tube, such that gas initially at line pressure of 6.5 mm Hg or less aspirates and mixes with an amount of air sufficient for complete combustion of the gas;

a combustion chamber substantially closed to the surrounding environment except through an exhaust flue and the aspirator/mixer assembly means such that all air combusted in the combustion chamber enters the combustion chamber with the fuel gas through the aspirator/mixer assembly; and burner means within the combustion chamber for receiving the premixed gas/air mixture from the preceeding aspirator/mixer assembly to substantially completely combust the gas/air mixture within the chamber, the combustion chamber being in heat exchange relationship with the water in the storage tank.

2. A storage water heater of the type having an insulated water storage tank, a water inlet and a water outlet to and from the water heater, and a gas fueled combustion assembly in which gas initially at line pressure mixes with combustion air without power assist and is ignited in a combustion chamber to heat water in the storage tank, the water heater comprising:

a combustion chamber comprising a plurality of upwardly extending straight tubes surrounding a burner within a closed housing having an exhaust flue, the combustion chamber limiting the flow of products of combustion from the burner to the flue such that all products of combustion from said burner pass outwardly between the upwardly extending tubes, the upper and lower ends of the tubes being in liquid communication with the interior of the storage tank for flow of water through the tubes to the storage tank by natural convection;

aspirator/mixer assembly means comprising a venturi mixer tube, a diffuser at the outlet of the mixer tube, an air inlet to the mixer tube and a fuel gas nozzle at the inlet for receiving fuel gas at line pressure of 6.5 mm Hg or less and forming a gas jet to draw air through the inlet to mix with the gas in the mixer tube, such that gas initially at line pressure of 6.5 mm Hg or less aspirates and mixes with an amount of air sufficient for complete combustion of the gas;

a burner in the combustion chamber for receiving the premixed gas/air mixture from the preceeding aspirator/mixer assembly to substantially completely combust the gas/air mixture within the chamber defined by the tubes, the products of combustion passing from the burner outward between the upwardly extending tubes surrounding the burner; and an exhaust flue through which the products of combustion exit the combustion chamber and which is thermally isolated from the water in the storage tank.

3. A storage water heater as claimed in claim 1 or 2 wherein the storage tank is lined with high temperature insensitive plastic material.

* * * * *